US005921192A

United States Patent [19]

Badillo

[11] Patent Number: 5,921,192

[45] Date of Patent: Jul. 13, 1999

[54] BOBBIN ASSEMBLY WITH STRUCTURE FOR SEVERING IMPROPERLY ROUTED THREAD

[75] Inventor: Paul Badillo, Littleton, Colo.

[73] Assignee: Bakron Corporation, Buffalo Grove, Ill.

[21] Appl. No.: 09/010,888

[22] Filed: Jan. 22, 1998

[51] Int. Cl.[6] ..... D05B 57/26

[52] U.S. Cl. ..... 112/231; 112/296

[58] Field of Search ..... 112/230, 231, 112/285, 296, 298; 83/902, 905, 910, 950

[56] References Cited

U.S. PATENT DOCUMENTS

| | | | |
|---|---|---|---|
| Re. 33,879 | 4/1992 | Shimizu . | |
| 3,658,021 | 4/1972 | Hedegaard et al. | 112/231 |
| 3,762,350 | 10/1973 | Starnes | 112/231 |
| 4,196,684 | 4/1980 | Kohara et al. | 112/231 X |
| 4,275,675 | 6/1981 | Killinger | 112/231 X |
| 4,858,543 | 8/1989 | Badillo . | |
| 5,109,783 | 5/1992 | Shimizu . | |
| 5,152,236 | 10/1992 | Hirose . | |
| 5,158,029 | 10/1992 | Hirose . | |
| 5,168,826 | 12/1992 | Hirose . | |
| 5,351,636 | 10/1994 | Hirose . | |
| 5,375,544 | 12/1994 | Badillo . | |
| 5,413,058 | 5/1995 | Hirose et al. . | |
| 5,474,004 | 12/1995 | Badillo . | |
| 5,598,799 | 2/1997 | Badillo . | |
| 5,617,803 | 4/1997 | Badillo . | |
| 5,651,323 | 7/1997 | Hirose et al. . | |

*Primary Examiner*—Ismael Izaguirre
*Attorney, Agent, or Firm*—Wood, Phillips, VanSanten, Clark & Mortimer

[57] ABSTRACT

A bobbin assembly having a base wall, a center post projecting away from the base wall in cantilever fashion, a peripheral wall assembly which extends at least partially around the center post, a hook assembly and at least one of a) a thread cutting slot and b) a knife edge on the bobbin assembly. At least a part of the hook assembly is rotatable around a first axis to engage a thread and cause an engaged thread to be formed into a loop as an incident of the at least part of the hook assembly rotating around the first axis. The at least one of the a) thread cutting slot and b) knife edge on the bobbin assembly severs a thread which is formed in a loop by the hook assembly as the at least part of the hook assembly is rotated around the first axis in operation, which loop, if constricted, would wrap against the center post.

25 Claims, 8 Drawing Sheets

50
42
52
54
56
58
59
60
62
64
72
74
76
78
80
A
B

BOBBIN ASSEMBLY WITH STRUCTURE FOR SEVERING IMPROPERLY ROUTED THREAD

BACKGROUND OF THE INVENTION

1. Field of the Invention

This invention relates to sewing machines and, more particularly, to a bobbin assembly on a sewing machine which causes improperly routed thread to sever before damage to, or impairment of the operation of, the sewing machine caused by the improperly routed thread can occur.

2. Background Art

Bobbin assemblies are used in a wide range of sewing machines. These bobbin assemblies typically have a receptacle within which a center post is formed to mount a thread retaining bobbin. In some systems, the bobbin axis is vertical, while in others the bobbin axis is horizontal.

The bobbin assembly typically has an element which is driven in rotation, continuously or in an oscillating manner, to define a loop in thread presented by a needle, through which stitching between the needle and bobbin threads is carried out. These bobbin assemblies commonly include a bobbin case/basket which fits in the receptacle or a cap which captively retains a bobbin in the receptacle. A pivotable latch element may be provided on the center post to maintain the cap in place and in turn the bobbin in its operative position in the receptacle.

Operator error accounts for a considerable amount of damage to sewing machines, which often results in significant down time. One operator induced problem results from either the improper securement of a bobbin case in its receptacle or failure to place the bobbin case in its receptacle prior to the operation of the sewing equipment. In equipment with a horizontal bobbin axis, the failure to place and lock the bobbin case/basket in its proper operative position, or to latch a bobbin in place, may result in the bobbin case escaping from its receptacle during operation of the sewing equipment. In a vertical axis system, operators at times may fail to install the bobbin cap or bobbin case in the basket or may leave the pivotable latch member in an unlatched state.

In all the above situations, and others which also occur, as the sewing machine is operated, thread in a loop formed by the bobbin assembly operating in either the continuous or oscillating manners, as it constricts, tends to route improperly and wrap around the center post. The thread take-up mechanism can cause a significant tension to be produced on the thread, particularly in heavy duty equipment which is designed to sew thick materials, such as heavy cloth and leather.

Many modern bobbin assemblies include non-metallic elements, such as a bobbin basket with an integrally formed center post. A constricted thread loop that has wrapped against the center post on these bobbin baskets may cause the center post to snap off the remainder of the basket. Since the initiated sewing operation may continue to run automatically until a particular cycle is completed or the overall system jams, the potential to inflict substantial damage on the center post, and elsewhere, exists. As an example, a 138 nylon thread may withstand in excess of 21.5 pounds before it breaks. This thread, aside from bending or breaking off the center post, may inflict damage to undertrimmer knives, hook raceways, thread retainer plates, and the hook elements before eventually causing a jam that stops the machine. Further, the stronger the thread the greater the potential is for damage.

While bobbin assemblies formed with metal center posts tend to withstand this condition better than those made from non-metallic materials, even the metal posts may become bent or broken in heavy duty applications. The metal latch element on the center post is particularly prone to being snagged and damaged by improperly routed thread.

Heretofore, nothing known to the inventor has been devised to address the above problem. It is known in the prior art to equip a bearing rib which guides rotation between the bobbin basket and a hook assembly, with a cutting element which severs thread before a substantial thread buildup occurs between the bobbin basket and the hook assembly. However, this structure does not cause severance of thread which is properly formed in a loop and which constricts to embrace the center post on the bobbin assembly in the absence of proper placement of bobbin cases or covers or proper situation of a movable latch on the center post. As a result, those in the sewing industry have generally contended with this problem by effecting the necessary repairs after the condition occurs, absorbing the losses attributable to this maintenance and down time.

SUMMARY OF THE INVENTION

The invention contemplates a bobbin assembly having a base wall, a center post projecting away from the base wall in cantilever fashion, a peripheral wall assembly which extends at least partially around the center post, a hook assembly, and at least one of a) a thread cutting slot and b) a knife edge on the bobbin assembly. At least a part of the hook assembly is rotatable around a first axis to engage a thread and cause an engaged thread to be formed into a loop as an incident of the at least part of the hook assembly rotating around the first axis. The at least one of the a) thread cutting slot and b) knife edge on the bobbin assembly severs a thread which is formed in a loop by the hook assembly as the at least part of the hook assembly is rotated around the first axis in operation, which loop, if constricted, would wrap against the center post.

The center post may be made with a main post portion and a latch element that is attached to the main post portion for selective movement relative to the main post portion between a) an unlatched position wherein a bobbin can be placed over the main center post portion into an operative position and b) a latched position wherein the latch element maintains a bobbin in an operative position in the operative position and the at least one of a) the thread cutting slot and b) the knife edge may be on at least one of the latch element and the main post portion.

The at least part of the bobbin hook that is rotatable around the first axis may be a hook element that is rotatable in a first direction around the first axis to cause the hook element to engage the thread and form a loop with engaged thread as the hook element rotates in the first direction. The at least one of a) the thread cutting slot and b) the knife edge may be on the hook assembly.

The peripheral wall assembly may be part of a bobbin basket that defines a receptacle for a bobbin. The bobbin basket has a radially projecting rib for guiding rotation of the at least part of the hook assembly relative to the bobbin basket and the at least one of a) the thread cutting slot and b) the knife edge may be formed on other than the radially projecting rib.

The bobbin basket may have an axial extent relative to the first axis and axially spaced first and second ends, with the center post projecting from the base wall towards the second axially spaced end of the bobbin basket. At least part of the at least one of a) the thread cutting slot and b) the knife edge extends to a location spaced axially relative to the central axis from the first axially spaced end of the bobbin basket a distance at least equal to one-half the distance between the first and second axially spaced ends of the bobbin basket.

The bobbin basket may have one piece that extends fully between the first and second axially spaced ends of the bobbin basket and which defines the at least one of a) the thread cutting slot and b) the knife edge.

In one form, the peripheral wall assembly is part of a bobbin basket that defines a receptacle for a bobbin which has first and second ends spaced axially with respect to the first axis, with the center post projecting from the base wall towards the second axially spaced end of the bobbin basket and the at least one of a) the thread cutting slot and b) the knife edge is closer to the second axially spaced end of the bobbin basket than to the first axially spaced end of the bobbin basket.

The first axis may extend vertically or horizontally.

The at least part of the hook assembly may be driven in rotation one of a) continuously in one direction and b) in an oscillating path around the first axis.

The thread cutting slot may be defined by a U-shaped opening with the base and two spaced guide edges which each join to the base, with at least one of the guide edge and the base being a knife edge.

In one form, the peripheral wall assembly defines a receptacle for a bobbin and the bobbin assembly further has a removable bobbin case in the receptacle which causes a loop defined by thread to be guided past the at least one of a) the thread cutting slot and b) the knife edge on the bobbin assembly without the thread defining the loop being cut by the at least one of a) the thread cutting slot and b) the knife edge.

In one form, the peripheral wall assembly is part of a bobbin basket that defines a receptacle for a bobbin and the bobbin basket has a peripheral wall with an opening therethrough which is bounded by the at least one of a) the thread cutting slot and b) the knife edge.

The invention also contemplates a sewing system having a needle, a drive for reciprocatingly moving the needle, a first supply of thread carried on the needle, and a bobbin assembly, as described above, together with a bobbin mounted on the center post and having a second supply of thread thereon and a hook assembly having at least a part that is rotatable around a first axis to draw thread carried by the needle into a loop.

DETAILED DESCRIPTION OF THE DRAWINGS

Figure 3:
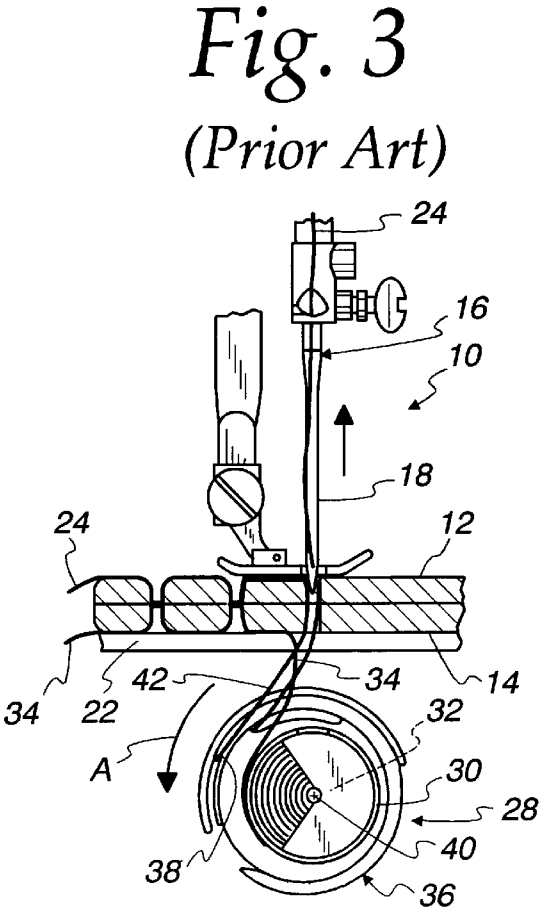
Fig. 3 (Prior Art)
FIG. 3 is a view as in FIGS. 1 and 2 wherein the needle is moving upwardly and the hook is rotating to enlarge the loop.
Figure 2:
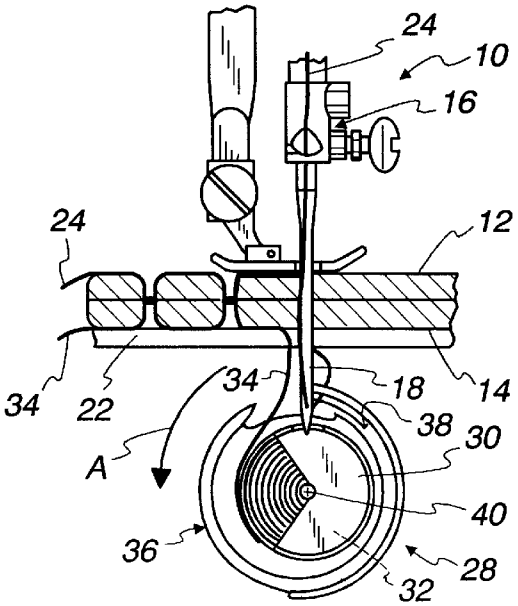
Fig. 2 (Prior Art)
FIG. 2 is a view as in FIG. 1 wherein the hook engages the needle thread to initiate the formation of a loop from the thread.

Referring initially to FIGS. 1–6, a conventional sewing machine is shown at 10 for stitching two sheets 12, 14 of sewable material. A needle assembly at 16, including a thread carrying needle 18, is operated through a drive 20 which causes the needle 18 to move reciprocatingly though a throat plate 22, which plate 22 supports the sheets 12, 14 to be sewn. Thread 24 carried by the needle 18 is delivered from a supply 26 thereof.

A bobbin assembly at 28 is located below the throat plate 22 and includes a bobbin case 30 which retains a bobbin 32 upon which a supply of a second thread 34 is wound.

Figure 1:
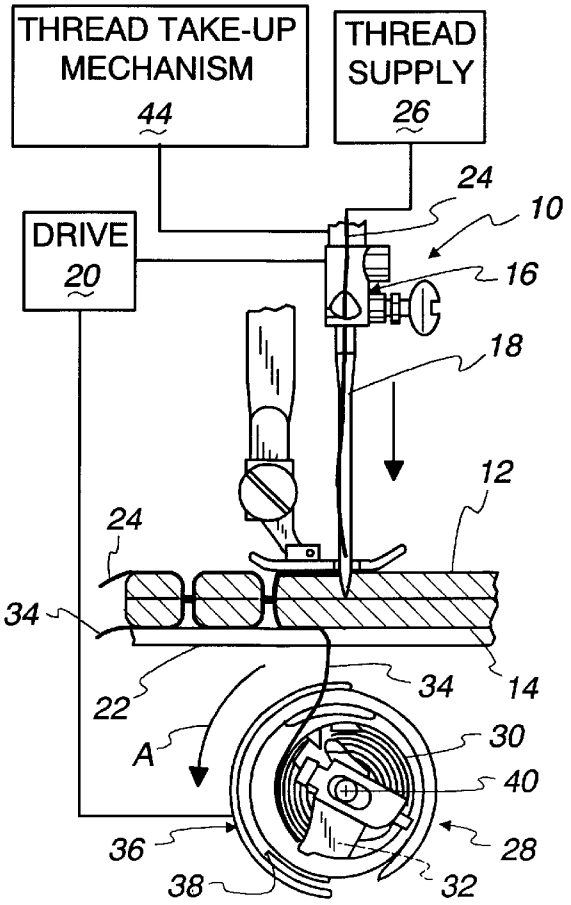
Fig. 1 (Prior Art)
FIG. 1 is a partial schematic, side elevation view of a conventional sewing machine with a thread carrying needle being directed downwardly through sheet material to cause a thread carried by the needle to be advanced into the path of a hook on a rotary bobbin assembly that is rotating around a horizontal axis.
Figure 6:
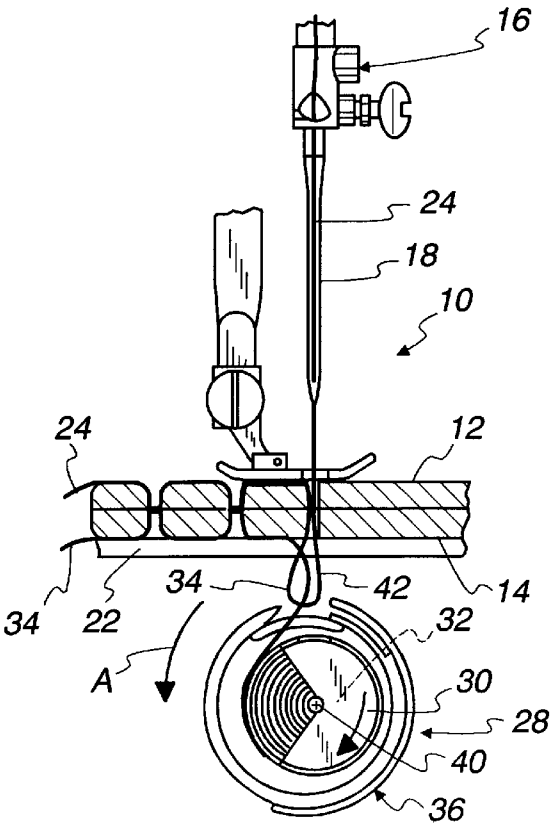
Fig. 6 (Prior Art)
FIG. 6 is a view as in FIGS. 1–5 wherein the loop is drawn taut by the take-up mechanism to effect a stitch.
Figure 5:
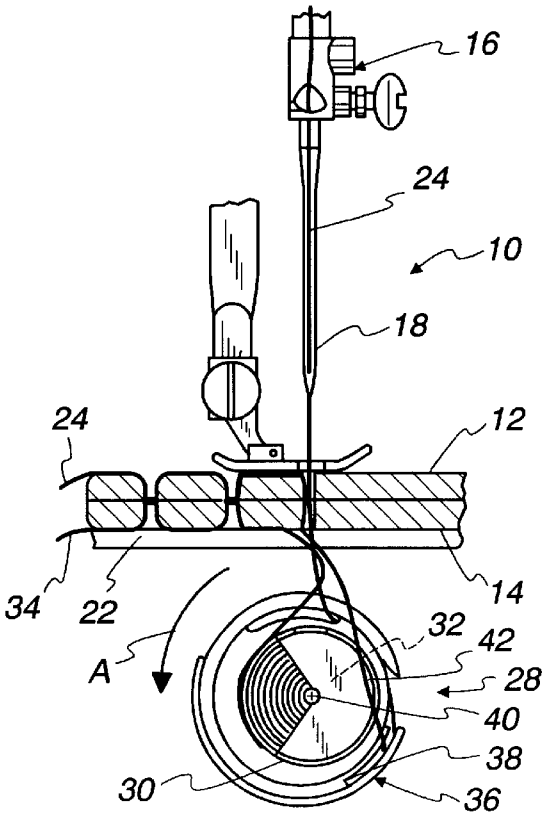
Fig. 5 (Prior Art)
FIG. 5 is a view as in FIGS. 1–4 wherein the loop slips from the hook as thread defining the loop is drawn upwardly by a take-up mechanism.
Figure 4:
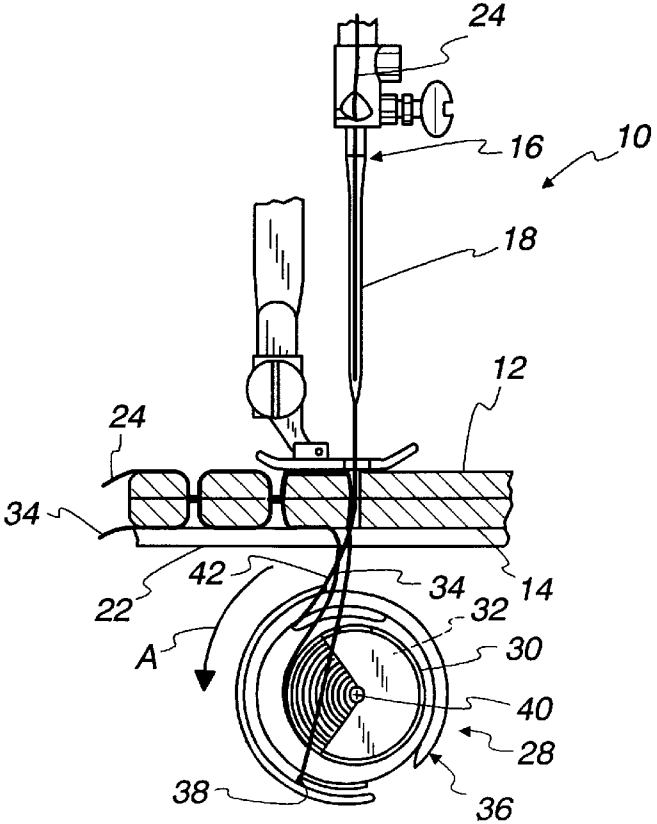
Fig. 4 (Prior Art)
FIG. 4 is a view as in FIGS. 1–3 wherein the loop is further enlarged as the needle advances upwardly.

In a typical sewing operation, the needle 18 advances downwardly, as in FIG. 1, into the sheets 12, 14 toward the bobbin assembly 28. A hook assembly 36, with a hook element 38 thereon, is rotated by the drive 20 in a counterclockwise direction i.e. in the direction of the arrow A, around a horizontally extending axis 40, as the needle 18 is reciprocated in a vertical path. The movement of the hook assembly 36 and needle 18 are coordinated so that, as see in FIG. 2, the hook element 38 engages the thread carried by the needle 18 which has descended through the throat plate 22. In FIG. 3, the needle 18 ascends as the hook element 38 continues to rotate, causing a loop 42 to be formed in the thread 34 and enlarged progressively to the point shown in FIG. 4. Continued rotation of the hook assembly 36 causes the thread loop 42 to separate from the hook element 38 as in FIG. 5, and eventually to separate altogether from the bobbin assembly 28, as in FIG. 6. At this point, a thread take-up mechanism 44 causes the thread 24 defining the loop 42 to be tightened. The thread 34 carried in the bobbin assembly 28 becomes enclosed in the loop 42.

With the bobbin 32 and bobbin case 30 operatively connected on the bobbin assembly 28, the loop 42 is released from the bobbin assembly 28 without any interference. A problem arises, as previously described in the Background portion herein, when the bobbin case 30 is absent. The problem is demonstrated in a modified form of sewing machine at 50 in FIGS. 7–16.

The sewing machine 50 is similar in construction to the conventional sewing machine 10, described above, with the difference residing in a bobbin assembly 52. The bobbin assembly 52 is a shuttle-type bobbin assembly which includes a hook assembly 54 with a hook element 56 thereon that rotates in a clockwise direction i.e. in the direction of the arrow A in FIGS. 7–10, 14 and 15, around a horizontally extending axis 58, and in a counterclockwise direction i.e. in the direction of arrow B in FIGS. 11–13 and 16, through another portion of the operating cycle. The hook element 56 has a bifurcated end defining cantilevered fingers 59, 60.

The bobbin assembly 52 has a center post 62 which extends in cantilever fashion from a base wall 64 along the axis 58. The center post 62, base wall 64, and hook assembly 58 cooperatively define a receptacle for a bobbin 66 (FIGS. 14–16) and a bobbin case 68, which contains the bobbin 66, in an operative state.

Figure 14:
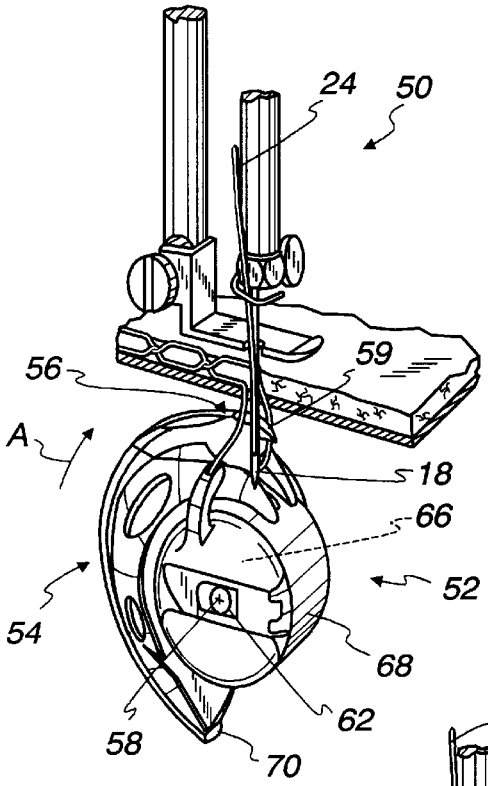
FIG. 14 is a fragmentary, perspective view of the sewing machine in FIGS. 7–13 with the bobbin case in place and the bobbin assembly in the state shown in FIG. 8.
Figure 15:
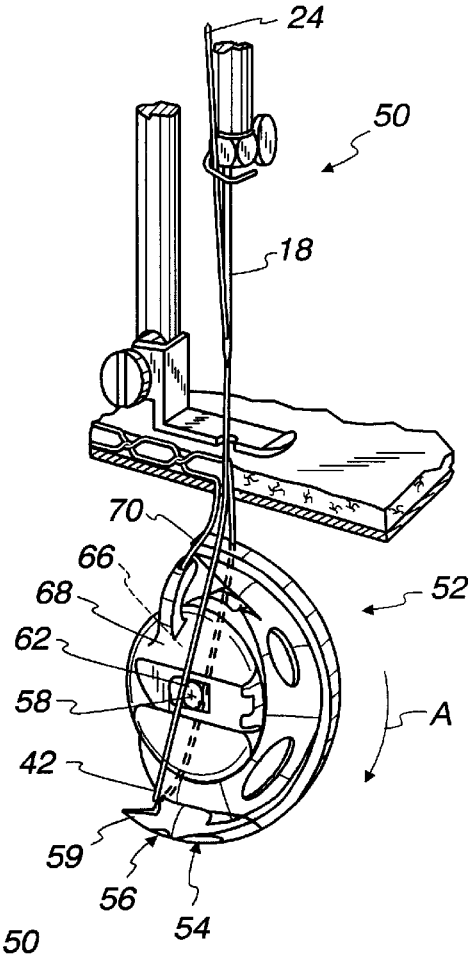
FIG. 15 is a view as in FIG. 14, with the bobbin case in place and with the bobbin assembly in the state shown in FIG. 10.
Figure 16:
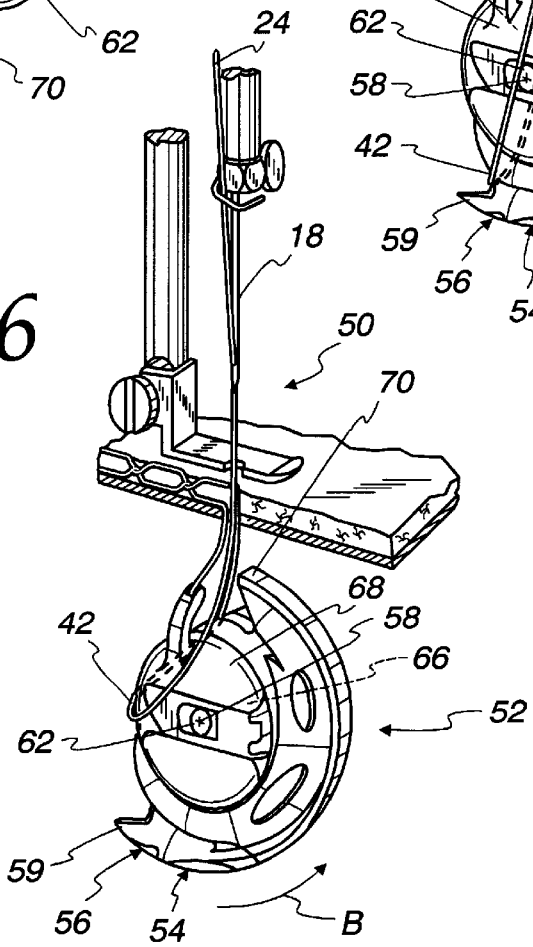
FIG. 16 is a view as in FIGS. 14 and 15 with the bobbin case in place and with the bobbin assembly in the state shown in FIG. 11.

With the bobbin case 68 operatively connected as in FIGS. 14–16, rotation of the hook element 56 causes the finger 59 to pick up the thread 24 from the needle 18. Continued rotation of the hook element 56 in a clockwise direction enlarges the thread loop 42 to the FIG. 15 state whereupon the thread loop 42 is tightened and constricted through the take-up mechanism 44, whereupon the loop 42 transfers to the finger 60. As the rotational direction of the hook element 56 reverses, as in FIG. 16, the loop 42 is constricted further by the upward movement of the thread 24 through the pick-up mechanism 44. The loop 42 slides against the bobbin case 68 and separates from the bobbin assembly 52 before the now leading end 70 of the hook assembly 58 can re-intercept the loop 42. However, in the event that the bobbin case 68 is not installed, entanglement between the thread loop 42 and the center post 62, as previously described, may occur. This condition is shown in FIGS. 7–13.

Figures 7, 8, 9, 10, 11, 12, 13:
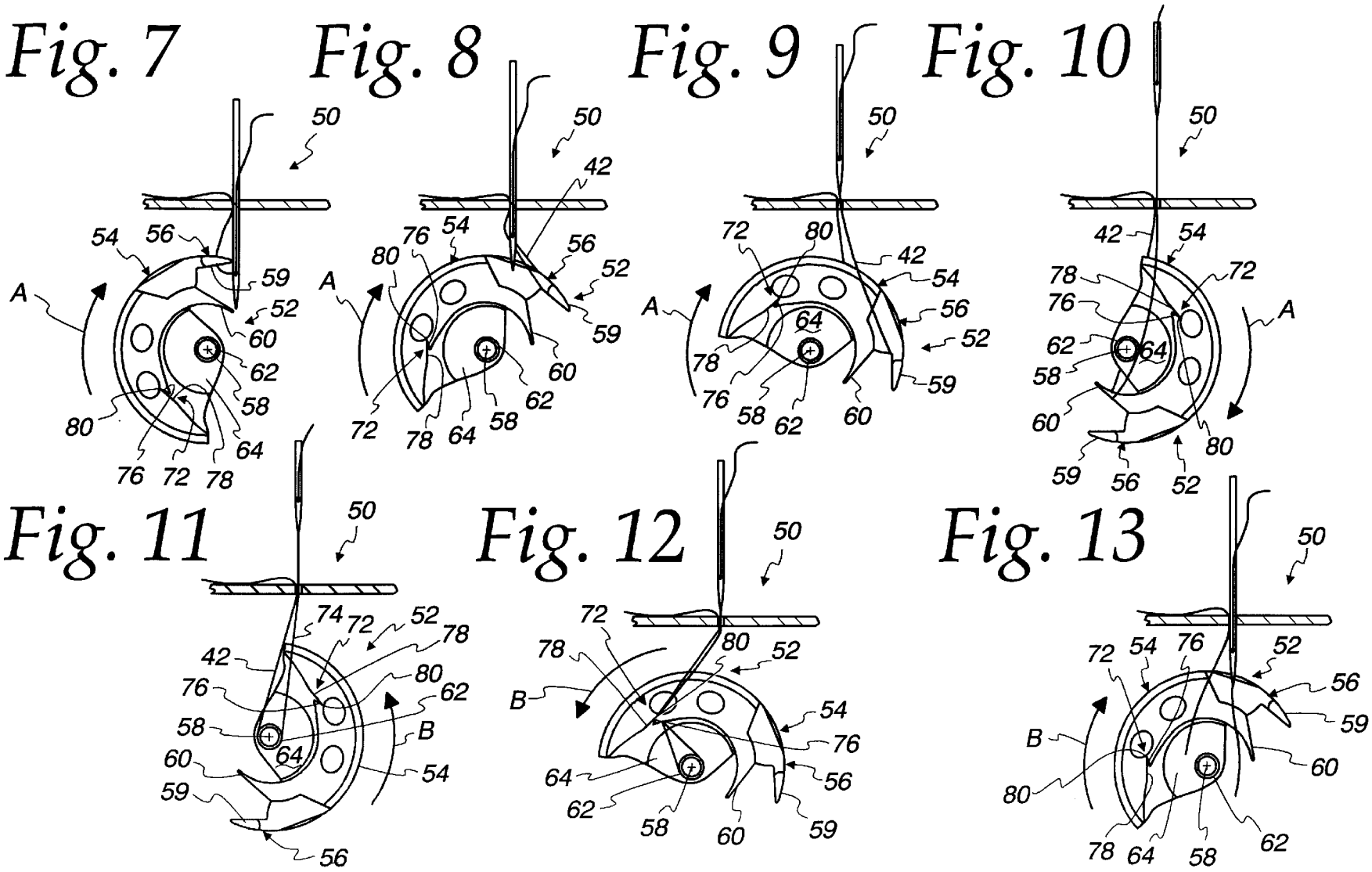
FIG. 7 is a view as in FIG. 1 of the sewing machine with a shuttle-type bobbin assembly, according to the present invention, defining a receptacle thereon for a bobbin case, and having a hook assembly with a hook element that is rotatable around a horizontal axis and with the bobbin case absent from the bobbin assembly as a sewing cycle is initiated with the needle advanced to direct thread into the path of the hook element on the bobbin assembly.
FIG. 8 is a view as in FIG. 7 with the hook element rotated further to engage the thread carried by the needle to initiate formation of a loop from the thread.
FIG. 9 is a view as in FIGS. 7 and 8 with the loop being further expanded by the rotating hook element.
FIG. 10 is a view as in FIGS. 7–9 with the hook element rotating to partially release the formed loop.
FIG. 11 is a view as in FIGS. 7–10 with the loop released and wrapping around a center post within the receptacle for mounting a bobbin and with the hook element having reversed its rotational direction.
FIG. 12 is a view as in FIGS. 7–11 with the thread forming the loop moved into a thread cutting slot in the hook assembly.
FIG. 13 is a view as in FIGS. 7–12 after the thread is severed in the thread cutting slot.

More specifically, as seen in FIGS. 7–9, the finger 59 initially engages the thread 24 and forms and enlarges the loop 42 progressively between the state shown in FIGS. 7 and 9. In FIG. 10, the loop 42, which is under tension generated through the thread take-up mechanism 44, is transferred to the finger 60. As the hook element 56 reverses rotational direction as in FIG. 11, the loop 42 is drawn off of the finger 60 and wraps tightly around the center post 62.

According to the invention, the hook assembly 58 has a U-shaped thread-cutting slot 72 formed therein. The slot 72 opens in a counterclockwise direction and intercepts the tensioned portion 74 of the loop 42 and effects severance thereof, as shown in FIGS. 12 and 13, to instantaneously release the pressure exerted by the thread 24 on the center post 62.

The thread cutting slot 72 has two generally straight edges 76, 78 which meet at a base 80. The edges 76, 78 and base 80 may all be defined by knife edges. Alternatively, the edges 76, 78 can converge to the base 80, whereupon the captured thread is severed as the hook assembly 54 continues to rotate in the direction of the arrow B i.e. in a counterclockwise direction.

Figure 17:
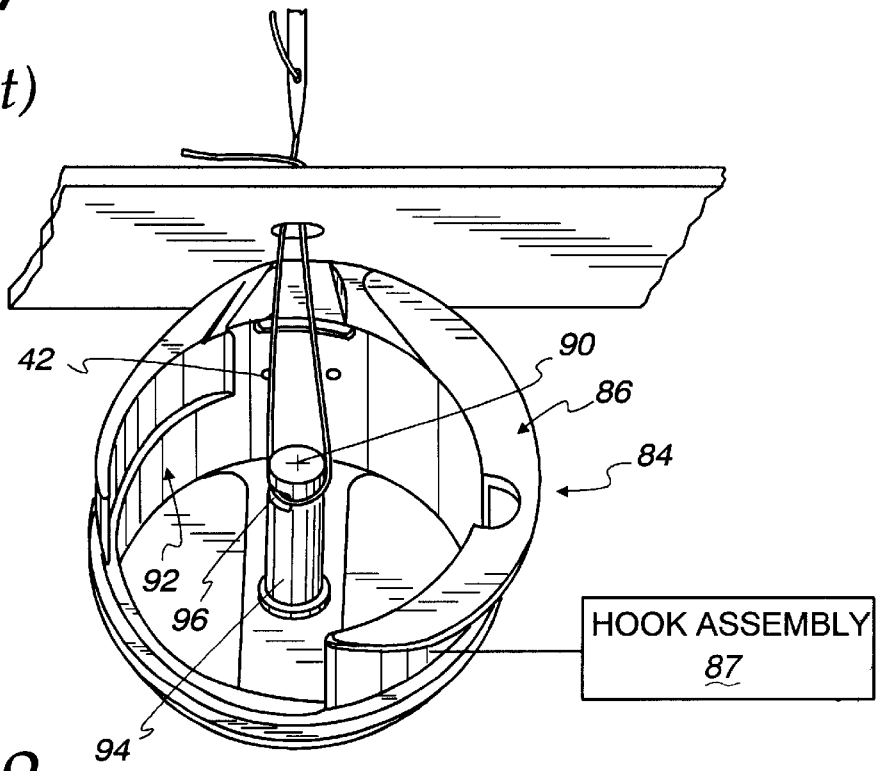
Fig. 17 (Prior Art)
FIG. 17 is a fragmentary, perspective view of a conventional bobbin basket without a bobbin therein and with a loop formed by a hook element rotating around the bobbin basket wrapped around the center post as in FIG. 11.
Figure 18:
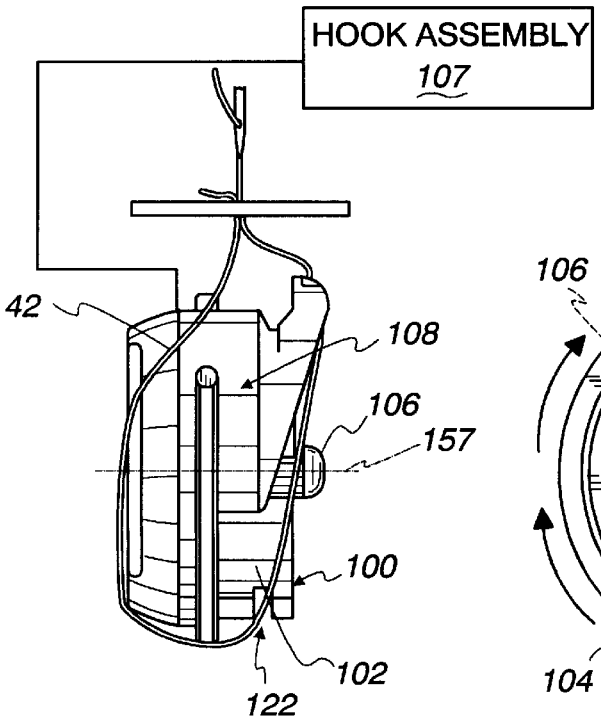
FIG. 18 is a fragmentary, side elevation view of a sewing machine with a bobbin basket as in FIG. 17 with a thread cutting slot, according to the present invention, incorporated therein and with the bobbin assembly in a state as in FIG. 17.
Figure 19:
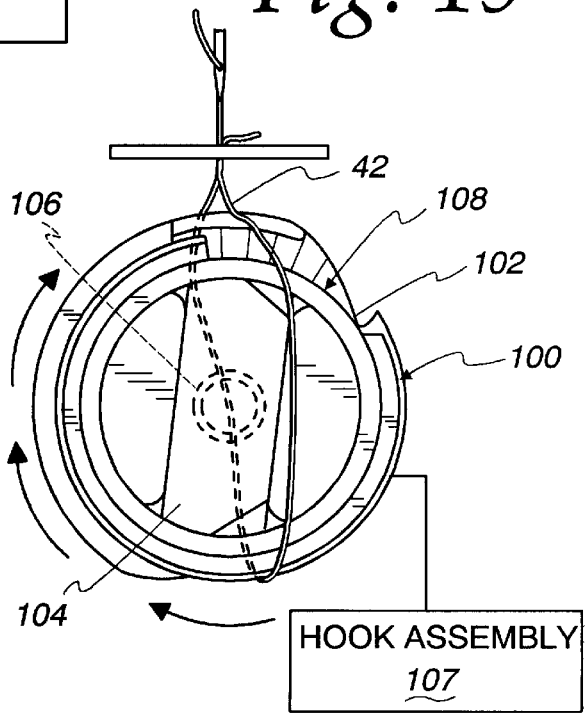
FIG. 19 is a rear elevation view of the sewing machine in FIG. 18.

In FIG. 17, another type of conventional bobbin assembly is shown at 84. The bobbin assembly 84 includes a bobbin basket 86 and a hook assembly 87 that is rotatable around a horizontal extending axis 90. The bobbin basket 86 defines a receptacle 92 for a bobbin and a cap/cover (not shown). With the system in FIG. 17 operated without the bobbin and cap/cover in place, the thread loop 42 is caused to be wrapped around a center post 94 during operation in the same manner as the loop 42 wraps around the center post 62, as previously described. This condition is further aggravated by a notch 96 which is conventionally formed in the center post 94 to accept a latch element associated with the bobbin and cap/cover. The notch 96 tends to retain the loop 42 i.e. prevents the loop from sliding to and off of the free end of the center post 94. This particular type of bobbin basket 86 is offered by the assignee herein in a non-metallic construction. The non-metallic center post 94 is particularly prone to breaking when this condition occurs.

A solution to this problem is shown in the inventive bobbin assembly at 100, shown in FIGS. 18–22. The bobbin assembly 100 consists of a bobbin basket 102 which has a base wall 104 and a center post 106 projecting axially from the base wall 104 in cantilever fashion. A hook assembly 107, with a hook element, rotates around the bobbin basket 102. The bobbin basket 102 has a peripheral wall 108 which in conjunction with the base wall 104 and center post 106 defines a receptacle for a bobbin (not shown). The peripheral wall 108 has an opening 110 therethrough bounded by circumferentially spaced and facing edges 112, 114.

With the condition corresponding to that in FIG. 11 occurring, the thread loop 42 wraps under a flange 116, against the edge 114 and around the center post 106 and in a notch 118 therein. By tensioning the thread 24, the take-up mechanism 44 constricts the loop 42 sufficiently that a substantial pressure is applied to the center post 106. To eliminate this problem, a thread cutting slot 122 is formed in the peripheral wall 108 through the edge 114. Spaced slot edges 124, 126 join at a base 128. The edges 124, 126 and base 128 can all be knife edges. As the hook element on the hook assembly 107 rotates, the thread loop 42 slides up the edge 114 on the peripheral wall 108 and into the slot 122, whereupon it is cut before excessive pressure is exerted by the thread 24 in the loop 42.

Figure 29:
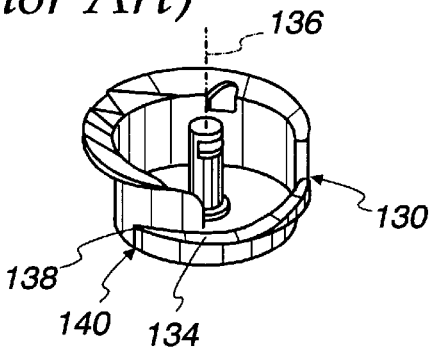
Fig. 29 (Prior Art)
FIG. 29 is a perspective view of a conventional bobbin basket having a bearing rib with a thread cutting capability incorporated therein.
Figure 30:
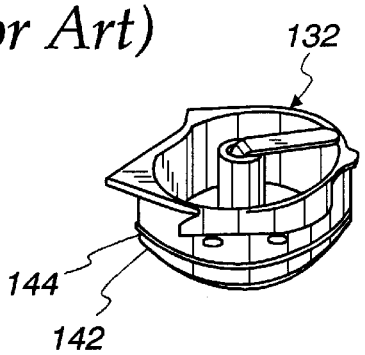
Fig. 30 (Prior Art)
FIG. 30 is a perspective view of a modified form of conventional bobbin assembly with a bearing rib having a thread cutting capability incorporated therein.

Referring to FIGS. 29 and 30, two different conventional bobbin baskets are shown at 130 and 132, respectively. The bobbin basket 130 has a bearing rib 134 projecting radially from a rotational axis 136 for the bobbin basket 130 which guides relative rotation between the bobbin basket 130 and a hook assembly (not shown). A cutting element 138 is formed in one circumferential end 140 of the bearing rib 134. While this cutting element 138 prevents excessive build up of thread between the bobbin basket 130 and hook assembly, the location of the bearing rib 134 is such that the cutting element 138 does not intercept the thread loop 42 and prevent the condition shown in FIG. 17.

The bobbin basket 132 has a like bearing rib 142 and a thread cutting element 144 at a circumferential end thereof. The cutting element 144 operates in the same general fashion as the cutting element 138.

Referring back to FIG. 22, the bobbin basket 102 has a bearing rib 150 which guides relative rotation between the bobbin basket 102 and hook assembly 107. It can be seen that the thread cutting slot 122 is spaced further from the base wall 104 than the bearing rib 150. The bobbin basket 102 has a main portion 152, absent the flange 116, which has first and second spaced ends 154, 156, respectively. The ends 154, 156 are spaced axially with respect to the axis 157 of the center post 106 by a distance D. The slot 122 is closer to the second end 152 than it is to the first end 154 of the main portion 152 of the bobbin basket 102. Preferably, the slot 122 extends to above the bottom one-third, and more preferably to above the bottom one-half of the axial extent (D) of the main portion 152 of the bobbin basket 102.

On the other hand, the conventional cutting elements 138, 144, shown in FIGS. 29 and 30, are in the corresponding lower one third of the baskets 130, 132.

Figure 23:
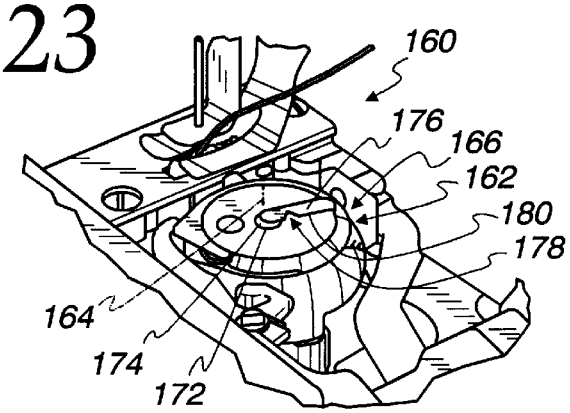
FIG. 23 is a fragmentary, perspective view of a sewing machine showing a vertical axis bobbin assembly with a center post having a latch element with a thread cutting slot therein and in which the latch element is in a latched state.
Figure 24:
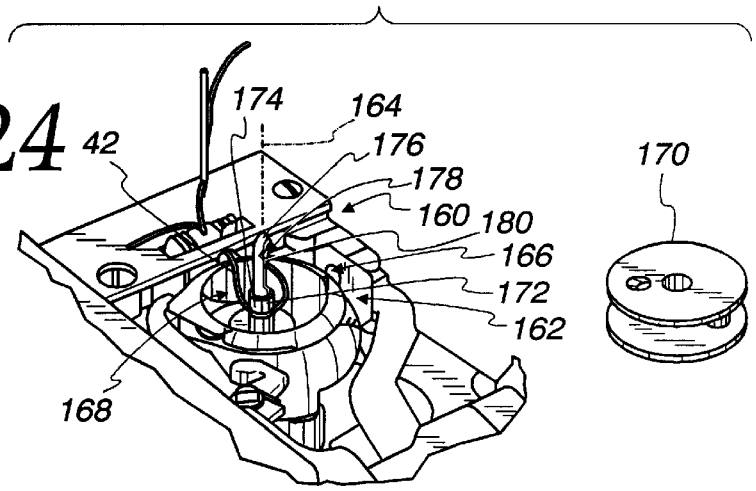
FIG. 24 is a view as in FIG. 23 with the latch element in an unlatched state.

In FIGS. 23 and 24, a sewing machine is shown at 160 having a bobbin assembly 162 that operates around a vertical axis 164. A bobbin basket/case 166 defines a receptacle 168 for a bobbin 170, which fits over a center post 172. The center post 172 has a main portion 174 and a latch element 176 which is mounted to the end of the main portion 174 of the center post 172 for pivoting movement between a latched position, shown in FIG. 23, and an unlatched position show at FIG. 24.

In FIG. 24, the thread loop 42 is shown wrapping around the center post 172, which is the condition previously described, with the bobbin basket/case 166 absent from the bobbin assembly 162. The latch element 176 in the unlatched position projects beyond the main portion 174 of the center post 172 in such a manner that the loop 42 cannot slide off of the latch element 176.

According to the invention, a thread cutting slot, having the configuration of either of the aforementioned slots 72, 122, is defined through an edge 180 of the latch element 176. As the thread in the loop 42 is drawn taut against the center post 172, it migrates into the slot 178 and is cut therewithin before a damaging pressure can be exerted by the thread 24 on the center post 172 through the latch element 176.

Figure 25:
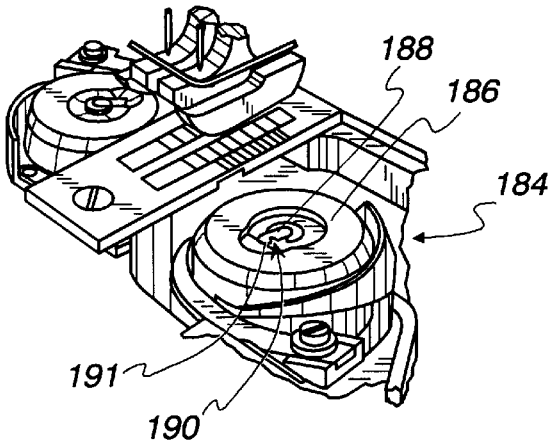
FIG. 25 is a view as in FIGS. 23 and 24 and showing a bobbin cap and modified form of latch element for the bobbin cap with a thread cutting slot, according to the present invention, incorporated therein and with the latch element in a latched state.
Figure 26:
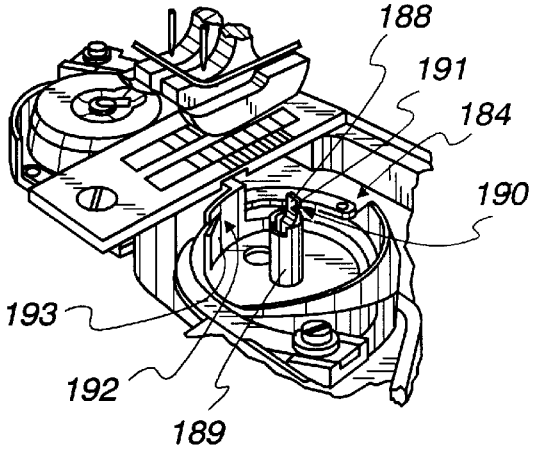
FIG. 26 is a view as in FIG. 25 with the bobbin cap separated therefrom and with the latch element in an unlatched state.

In FIGS. 25 and 26, a modified form of bobbin assembly is shown at 184, which likewise operates around a vertical axis. In this embodiment, a cap 186 is employed over the bobbin 170 and is captively maintained in place by a latch element 188 on a center post 189. A thread cutting slot 190, similar to the thread cutting slot 178, is formed on the edge 192 of the latch element 188 to function in the same manner as the thread cutting slot 178 functions in the environment in FIGS. 23 and 24. An additional thread cutting slot 192, the same as those previously described, is formed in a wall 193 defining a receptacle for the bobbin 170.

Figure 27:
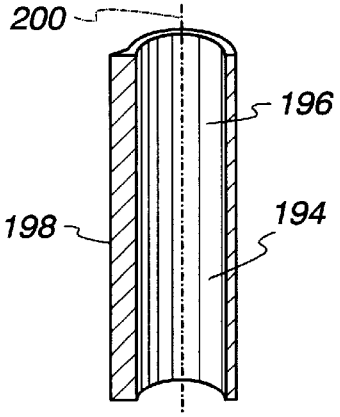
FIG. 27 is a fragmentary, elevation view of a center post having a thread cutting knife edge, according to the present invention, incorporated therein.

FIG. 27 shows another form of the present invention on a portion of a center post 194 that can be used to penetrate and support a bobbin in any bobbin assembly configuration. The center post 94 has a main, cylindrical body 196 with a knife edge 198 that projects radially outwardly with respect to the central axis 200 for the post 194.

Thus, when the thread and the loop 42 wrap against the post 194, the thread is severed at a predetermined pressure. The knife edge 198 is strategically located to cut the thread 24 before it is capable of exerting a damaging pressure on the post 194. Multiple knife edges 198 can be disposed circumferentially around the center post 194.

Figure 28:
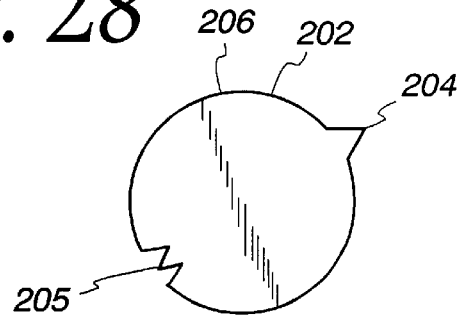
FIG. 28 is an end view of a modified form of center post, according to the present invention, and having two different types of thread cutting knife edges, according to the present invention, incorporated therein.

In FIG. 28, a modified form of center post is shown at 202 having a knife edge 204, corresponding to the knife edge 198 and projecting radially therefrom. In this embodiment, a knife edge 205 is shown recessed radially inwardly from the peripheral surface 206 of the center post 202. The knife edge 205 can be mounted so that an exposed cutting portion thereof is substantially flush with the peripheral surface 206, thereby avoiding inadvertent cutting of the hand of the operator as the bobbin is placed over the center post 202. For added safety, the exposed edge may be slightly recessed radially inwardly from the peripheral surface 206 and still perform the necessary cutting function.

Figure 20:
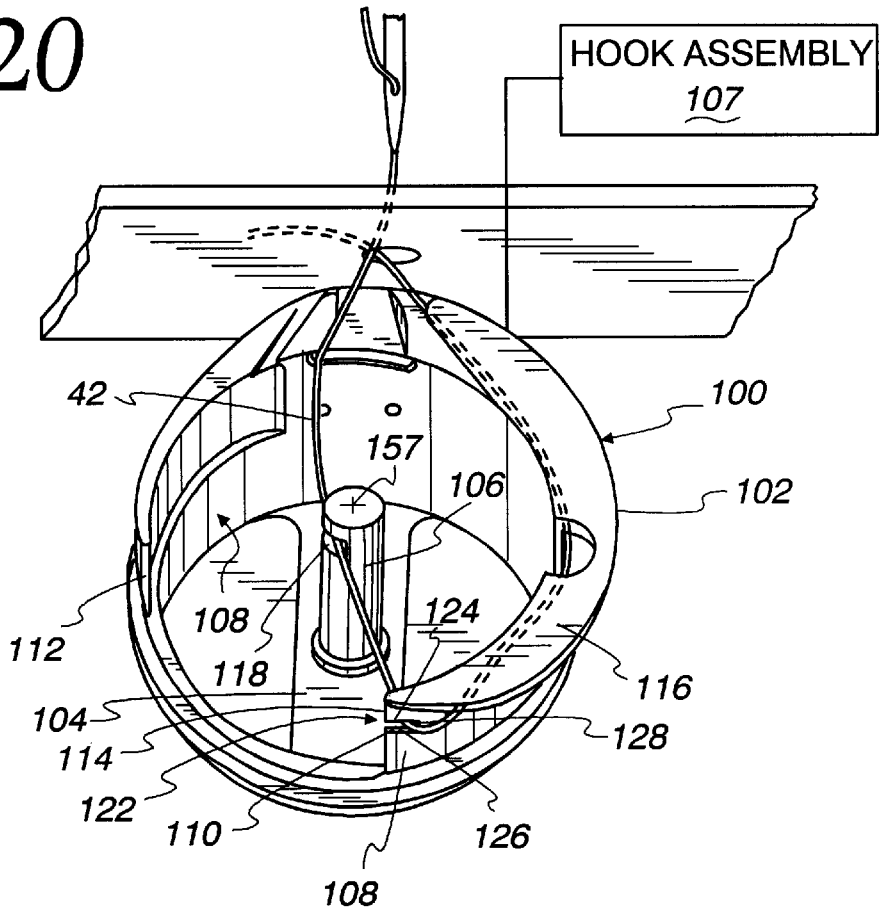
FIG. 20 is an enlarged, fragmentary, perspective view of the sewing machine in FIGS. 18 and 19 with the thread wrapped around the center post and being severed in the inventive thread cutting slot.
Figure 21:
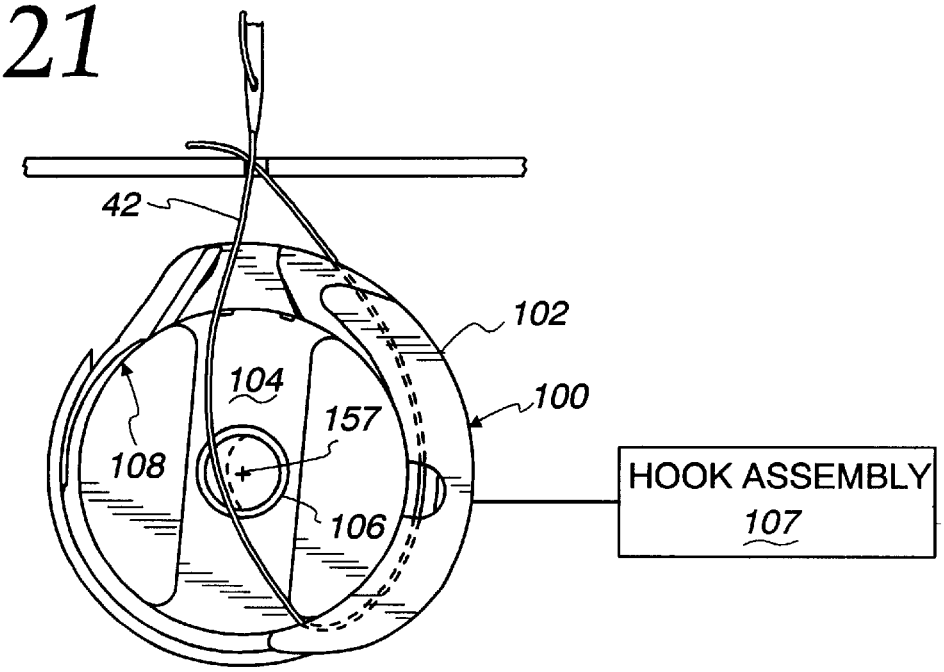
FIG. 21 is an enlarged, front elevation view corresponding to that in FIG. 20.
Figure 22:
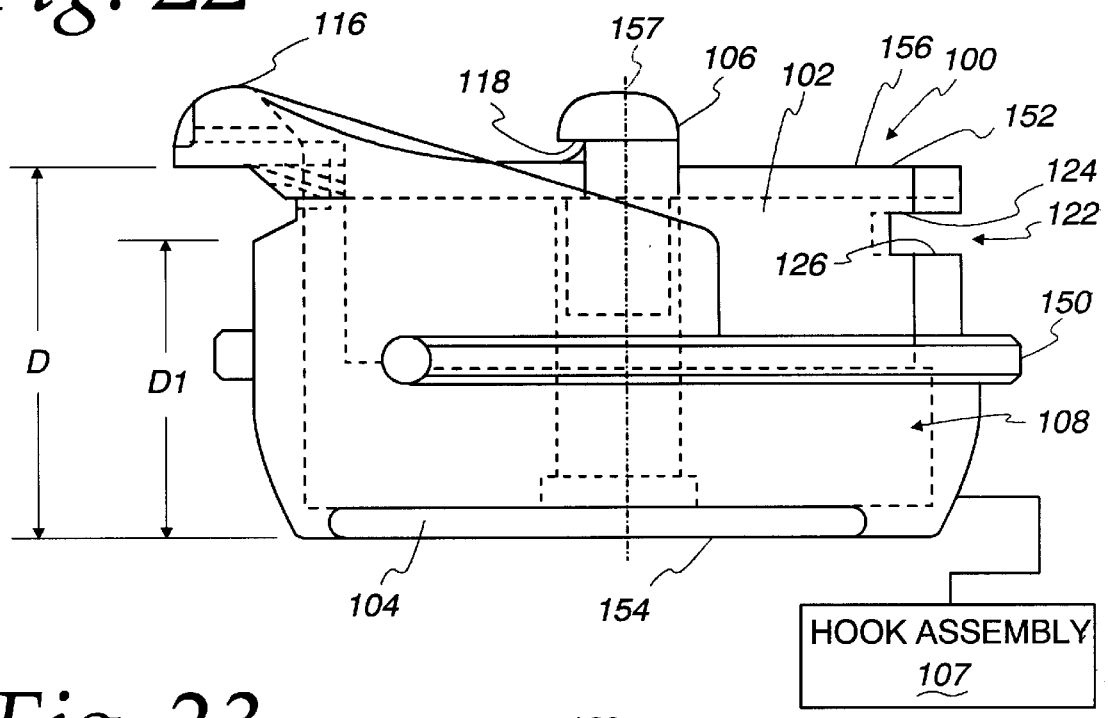
FIG. 22 is an enlarged, plan view of the bobbin basket in FIGS. 18–21.

Another variation of the invention is shown in FIG. 20, wherein the edge 114 is formed as a knife edge The primary drawback to this construction is that a sharp edge is exposed to the user handling the bobbin basket 102.

The foregoing disclosure of specific embodiments is intended to be illustrative of the broad concepts comprehended by the invention.

I claim:

1. A bobbin assembly comprising:

a base wall;

a center post projecting away from the base wall in cantilever fashion;

a peripheral wall assembly which extends at least partially around the center post;

a hook assembly, at least a part of the hook assembly being rotatable around a first axis to engage a thread and cause an engaged thread to be formed into a loop as an incident of the at least part of the hook assembly rotating around the first axis; and at least one of a) a thread cutting slot and b) a knife edge on the bobbin assembly for severing a thread which is formed in a loop by the bobbin assembly as the at least part of the hook assembly is rotated around the first axis in operation and which loop, if constricted, would wrap against the center post.

2. The bobbin assembly according to claim 1 wherein the center post comprises a main post portion and a latch element that is attached to the main post portion for selective movement relative to the main post portion between a) an unlatched position wherein a bobbin can be placed over the main center post portion into an operative position and b) a latched position wherein the latch element maintains a bobbin in an operative position in the operative position and the at least one of a) the thread cutting slot and b) the knife edge is on at least one of the latch element and the main post portion.

3. The bobbin assembly according to claim 1 wherein the at least part of the hook assembly that is rotatable around the first axis comprises a hook element that is rotatable in a first direction around the first axis to cause the hook element to engage a thread and form a loop with engaged thread as the hook element rotates in the first direction, and the at least one of a) the thread cutting slot and b) the knife edge is on the hook assembly.

4. The bobbin assembly according to claim 1 wherein the peripheral wall assembly is part of a bobbin basket that defines a receptacle for a bobbin, the bobbin basket has a radially projecting rib for guiding rotation of the at least part of the hook assembly relative to the bobbin basket and the at least one of a) the thread cutting slot and b) the knife edge is formed on other than the radially projecting rib.

5. The bobbin assembly according to claim 1 wherein the peripheral wall is part of a bobbin basket that defines a receptacle for a bobbin, the bobbin basket has an axial extent relative to the first axis and axially spaced first and second ends with the center post projecting from the base wall toward the second axially spaced end of the bobbin basket and at least part of the at least one of a) the thread cutting slot and b) the knife edge extends to a location spaced axially relative to the central axis from the first axially spaced end of the bobbin basket a distance at least equal to one-half the distance between the first and second axially spaced ends of the bobbin basket.

6. The bobbin assembly according to claim 5 wherein the bobbin basket has one piece that extends fully between the first and second axially spaced ends of the bobbin basket and defines the at least one of a) the thread cutting slot and b) the knife edge.

7. The bobbin assembly according to claim 1 wherein the peripheral wall assembly is part of a bobbin basket that defines a receptacle for a bobbin which has first and second ends spaced axially with respect to the first axis, the center post projects from the base wall toward the second axially spaced end of the bobbin basket and the at least one of a) the thread cutting slot and b) the knife edge is closer to the second axially spaced end of the bobbin basket than to the first axially spaced end of the bobbin basket.

8. The bobbin assembly according to claim 1 wherein the first axis extends vertically.

9. The bobbin assembly according to claim 1 wherein the first axis extends horizontally.

10. The bobbin assembly according to claim 1 wherein the peripheral wall is defined by a bobbin basket and further comprising a drive for rotating the at least part of the hook assembly relative to the bobbin basket one of a) continuously in one direction and b) in an oscillating path around the first axis.

11. The bobbin assembly according to claim 1 wherein the thread cutting slot comprises a U-shaped opening with a base and two spaced guide edges which each join to the base and at least one of the guide edges and the base is a knife edge.

12. The bobbin assembly according to claim 3 wherein the peripheral wall assembly defines a receptacle for a bobbin and the bobbin assembly further comprises a removable bobbin case in the receptacle which causes a loop defined by thread to be guided past the at least one of a) the thread cutting slot and b) the knife edge on the bobbin assembly without the thread defining the loop being cut by the at least one of a) the thread cutting slot and b) the knife edge.

13. The bobbin assembly according to claim 1 wherein the peripheral wall assembly is part of a bobbin basket that defines a receptacle for the bobbin, and the bobbin basket has a peripheral wall having an opening therethrough which is bounded by the at least one of a) the thread cutting slot and b) the knife edge.

14. A sewing system comprising:

a needle;

a drive for reciprocatingly moving the needle;

a first supply of thread carried on through the needle; and a bobbin assembly comprising:

a) a base wall;

b) a center post projecting away from the base wall in cantilever fashion;

c) a peripheral wall assembly which extends at least partially around the center post;

d) a bobbin mounted on the center post and having a second supply of thread thereon; and e) a hook assembly having at least a part that is rotatable around a first axis to draw thread carried by the needle into a loop, wherein there is at least one of a) a thread cutting slot and b) a knife edge on the bobbin assembly for severing the loop formed by the hook subassembly which loop, if constricted, would wrap against the center post.

15. The sewing system according to claim 14 wherein the center post comprises a main post portion and a latch element that is attached to the main post portion for selective movement relative to the main post portion between a) an unlatched position wherein a bobbin can be placed over the main center post portion into an operative position and b) a latched position wherein the latch element maintains a bobbin in an operative position in the operative position and the at least one of a) the thread cutting slot and b) the knife edge is on at least one of the latch element and the main post portion.

16. The bobbin assembly according to claim 14 wherein the at least part of the hook assembly that is rotatable around the first axis comprises a hook element that is rotatable in a first direction around the first axis to cause the hook element to engage a thread and form a loop with engaged thread as the hook element rotates in the first direction, and the at least one of a) the thread cutting slot and b) the knife edge is on the hook subassembly.

17. The bobbin assembly according to claim 14 wherein the peripheral wall assembly a part of a bobbin basket that defines a receptacle for a bobbin, the bobbin basket has a radially projecting rib for guiding rotation of the at least part of the hook assembly relative to the bobbin basket and the at least one of a) the thread cutting slot and b) the knife edge is formed on other than the radially projecting rib.

18. The bobbin assembly according to claim 14 wherein the peripheral wall assembly is part of a bobbin basket that defines a receptacle for a bobbin, the bobbin basket has an axial extent relative to the first axis and axially spaced first and second ends with the center post projecting from the base wall toward the second axially spaced end of the bobbin basket and at least part of the at least one of a) the thread cutting slot and b) the knife edge extends to a location spaced axially relative to the central axis from the first axially spaced end of the bobbin basket a distance at least equal to one-half the distance between the first and second axially spaced ends of the bobbin basket.

19. The bobbin assembly according to claim 18 wherein the bobbin basket has one piece that extends fully between the first and second axially spaced ends of the bobbin basket and defines the at least one of a) the thread cutting slot and b) the knife edge.

20. The bobbin assembly according to claim 14 wherein the peripheral wall is part of a bobbin basket that defines a receptacle for a bobbin which has first and second ends spaced axially with respect to the first axis, the center post projects from the base wall toward the second axially spaced end of the bobbin basket and the at least one of a) the thread cutting slot and b) the knife edge is closer to the second axially spaced end of the bobbin basket than to the first axially spaced end of the bobbin basket.

21. The bobbin assembly according to claim 14 wherein the first axis extends vertically.

22. The bobbin assembly according to claim 14 wherein the first axis extends horizontally.

23. The bobbin assembly according to claim 14 wherein the peripheral wall is defined by a bobbin basket and further comprising a drive for rotating the at least part of the hook assembly drive for rotating the at least part of the hook assembly one of a) continuously in one direction and b) in an oscillating path around the first axis.

24. The bobbin assembly according to claim 16 wherein the peripheral wall assembly defines a receptacle for a bobbin and the bobbin assembly further comprises a removable bobbin case in the receptacle which causes a loop defined by thread to be guided past the at least one of a) the thread cutting slot and b) the knife edge on the bobbin assembly without the thread defining the loop being cut by the at least one of a) the thread cutting slot and b) the knife edge.

25. The bobbin assembly according to claim 14 wherein the peripheral wall is part of a bobbin basket that defines a receptacle for the bobbin, and the bobbin basket has a peripheral wall having an opening therethrough which is bounded by the at least one of a) the thread cutting slot and b) the knife edge.

* * * * *